US006942307B1

(12) United States Patent
Lammens

(10) Patent No.: US 6,942,307 B1
(45) Date of Patent: Sep. 13, 2005

(54) STOPPER APPARATUS FOR SLIDE RAIL

(75) Inventor: Arthur Edward Lammens, Carson, CA (US)

(73) Assignees: Sugatsune Kogyo Co., Ltd., Tokyo (JP); Sugatsune America, Inc., Carson, CA (US)

( * ) Notice: Subject to any disclaimer, the term of this patent is extended or adjusted under 35 U.S.C. 154(b) by 72 days.

(21) Appl. No.: 10/813,584

(22) Filed: Mar. 30, 2004

(51) Int. Cl.[7] ..... A47B 88/04
(52) U.S. Cl. ..... 312/334.46; 312/334.1
(58) Field of Search ..... 312/330.1, 334.1, 312/334.7, 334.8, 334.44, 334.46, 334.47, 312/333, 334.11; 384/18, 21

(56) References Cited

U.S. PATENT DOCUMENTS 2,277,702 A * 3/1942 Kennedy ..... 312/334.8
3,650,578 A * 3/1972 Del Vecchio et al. ..... 384/18
4,998,828 A * 3/1991 Hobbs ..... 384/18
6,373,707 B1 * 4/2002 Hutchins ..... 361/725
6,585,337 B1 * 7/2003 Chen et al. ..... 312/334.46

FOREIGN PATENT DOCUMENTS

EP 35595 * 9/1981
JP 2541480 4/1997

* cited by examiner

*Primary Examiner*—James O. Hansen
(74) *Attorney, Agent, or Firm*—Osha & May L.L.P.

(57) ABSTRACT

Lock plate portions are formed in a front end portion of a flat plate portion of a first rail. A stopper member is mounted on a flat plate portion of a second rail. A lock hole and elastic strips are provided on a sloping plate portion of the stopper member. The lock hole is disposed such that it faces the lock plate portions when the second rail moves in the forward direction to a predetermined position. When the lock plate portion faces the lock hole, the elastic strip displaces a front end portion of the sloping plate portion to the flat plate portion side using elastic force of the elastic strip itself and elastic force of the sloping plate portion. Accordingly, the lock plate portions are relatively received in the lock hole.

6 Claims, 9 Drawing Sheets

STOPPER APPARATUS FOR SLIDE RAIL

BACKGROUND OF THE INVENTION

The present invention relates to a stopper apparatus for a slide rail provided between a body and a drawer or the like.

In general, a slide rail is provided with a first rail and a second rail as disclosed in Japanese Utility Model No. 2541480. Each first rail of a pair of the slide rails is fixed to left and right side portions of a housing portion of a body, respectively, such that the longitudinal direction thereof is in alignment with the back and forth direction. Meanwhile, each second rail of the pair of slide rails is fixed to left and right side portions of a drawer housed in the housing portion of the body, respectively. Moreover, each second rail is supported so as to be movable in the back and forth direction by the corresponding first rail. Consequently, the drawer is supported so as to be movable in the back and forth direction by the housing portion of the body through the pair of slide rails.

A stopper apparatus is provided between the first rail and the second rail of the slide rail. The stopper apparatus, for example, inhibits the second rail from moving forward further than a predetermined position with respect to the first rail, thereby inhibiting the drawer from falling out of the body. The stopper member is provided with a lock portion which is mounted on a face facing the second rail (i.e., an inner face) of the first rail, such that the lock portion projects toward the second rail, and a stopper member which is formed in a face facing the first rail (i.e., an inner face) of the second rail.

The stopper member is formed of an elastic metal plate material. It has an attachment portion fixed to the second rail, a sloping plate portion (plate portion) which is formed so as to be continuous with a front end portion of the attachment portion and which is inclined such that a front portion of the sloping plate portion is closer to the first rail than the rear portion thereof, and a guide portion which is formed so as to be continuous with a front end portion of the sloping plate portion such that a front portion of the guide portion is closer to the second rail than the rear portion thereof. A lock hole (lock recess portion) is formed in the front end portion of the sloping plate portion into which the lock portion is received so as to freely get in and come out of the lock hole. The guide portion contacts the lock portion when the second rail moves in the forward direction to a predetermined first position. Therefore, when the second rail moves further in the forward direction, the guide portion slides on the lock portion. Consequently, the sloping plate portion is elastically deformed so as to approach the second rail. Subsequently, when the second rail moves to a predetermined second position, the lock hole faces the lock portion. Then, the sloping plate portion is elastically deformed so as to return to the original position such that the front end portion of the sloping plate portion approaches the first rail, and the lock portion is received in the lock hole. When an attempt is made to move the second rail in the forward direction with the lock portion being received in the lock hole, a rear end face of the lock hole contacts the lock portion, whereby the second rail 2 is inhibited from moving in the forward direction.

In the conventional stopper apparatus as described above, in order to reliably inhibit the second rail from moving forward further than the predetermined second position, it is necessary that when the second rail moves to the second position, the lock portion be reliably received in the lock hole and that this state be reliably maintained. In order to achieve this, a modulus of elasticity of the stopper member, particularly a modulus of elasticity of the sloping plate portion needs to become larger. By doing so, elastic force becomes large when the sloping plate portion returns to the original state, whereby the lock portion is reliably received in the lock hole. However, if elastic return force of the sloping plate portion is made larger by increasing the modulus of elasticity thereof, large stress is generated in the sloping plate portion when the sloping plate portion is elastically deformed toward the second rail by the guide portion. Particularly, large stress is generated at an intersection portion of the sloping plate portion and the attachment portion. Therefore, the stopper member could be damaged at the intersection portion of the sloping plate portion and the attachment portion at an early time.

Note that when the modulus of elasticity of the sloping plate portion is made smaller, stress generated in the sloping plate portion becomes also small, thereby preventing the stopper member from being damaged at an early time. In this case, however, since the sloping plate portion is elastically deformed even by small force, the lock portion may easily get out of the lock hole when force in the forward direction acts on the second rail. This makes it difficult to reliably inhibit the second rail from moving forward further than the predetermined second position.

SUMMARY OF THE INVENTION

In order to solve the aforementioned problems, it is an object of the present invention to provide a stopper apparatus for a slide rail. The stopper apparatus for a slide rail having a first rail and a second rail which are coupled so as to be capable of mutual relative movement in a longitudinal direction, the stopper apparatus is characterized by comprising:

- a lock portion which projects toward the second rail and which is formed in a distal end portion of an inner face of the first rail, this inner face facing the second rail;
- a stopper member made of an elastic plate material formed in a rear end portion of the inner face of the second rail, facing the first rail; the stopper member comprising:
  - an attachment portion which is formed in a base end portion of the stopper member, and which is fixed to the inner face of the second rail;
  - a plate portion which is formed so as to be continuous with a distal end portion of the attachment portion, and which extends toward the distal end portion of the second rail such that the plate portion is separated from the inner face of the second rail; and
  - a guide portion which is formed so as to be continuous with the distal end portion of the plate portion, such that, when the second rail moves toward the distal end side and reaches a predetermined first position, the guide portion contacts the lock portion, and slides on the lock portion in accordance with movement of the second rail from the first position to the distal end side, thereby elastically displacing the plate portion around the base end portion to the second rail side,
  - the plate portion further comprising:
    - a lock recess portion formed in the distal end portion such that, when the second rail moves further from the first position toward the distal end side and reaches the predetermined second position, the lock recess portion faces the lock portion, and receives the lock portion due to the plate portion being elastically deformed to return to the second rail side, and thereby inhibiting the second rail from moving in the longitudinal direction by engagement of the lock portion with the lock recess portion; and an elastic strip which projects toward the second rail and which elastically urges the plate portion to the inner face side of the first rail by contacting an abutment portion formed in the second rail; wherein when the lock portion is received in the lock recess portion, a distance between the elastic strip and the abutment portion in a direction in which the inner face of the first engagement portion and the inner face of the second engagement portion face each other is set smaller than an insertion distance of the lock portion into the lock recess portion.

In this case, the second rail may be inhibited from moving toward the distal end side by contact of the lock portion with a rear end face of the lock recess portion, and the second rail may be inhibited from moving toward the rear end side by contact of the lock portion with a distal end face of the lock recess portion.

It is preferable that the elastic strip is inclined such that a front portion of the elastic strip is closer to the second rail than the distal end portion thereof so as to also serve as the guide portion, and, when the second rail moves toward the distal end side and reaches the first position, a face of the elastic strip facing the first rail contacts the lock portion.

It is also preferable that a thorough hole which receives the distal end portion is further formed in the second rail, and the abutment portion is formed at an intersection portion of the inner peripheral face of the through hole and the inner face of the second rail.

The stopper apparatus may further including a fixed rail and a movable rail such that longitudinal directions thereof are in alignment with longitudinal directions of the first rail and the second rail, wherein the movable rail is coupled to the fixed rail so as to be movable in the longitudinal direction of the fixed rail and the first rail is fixed to the movable rail.

DETAILED DESCRIPTION OF THE PREFERRED EMBODIMENTS

Hereinafter, embodiments of the present invention will be explained referring to FIGS. 1 to 9.

Figure 1:
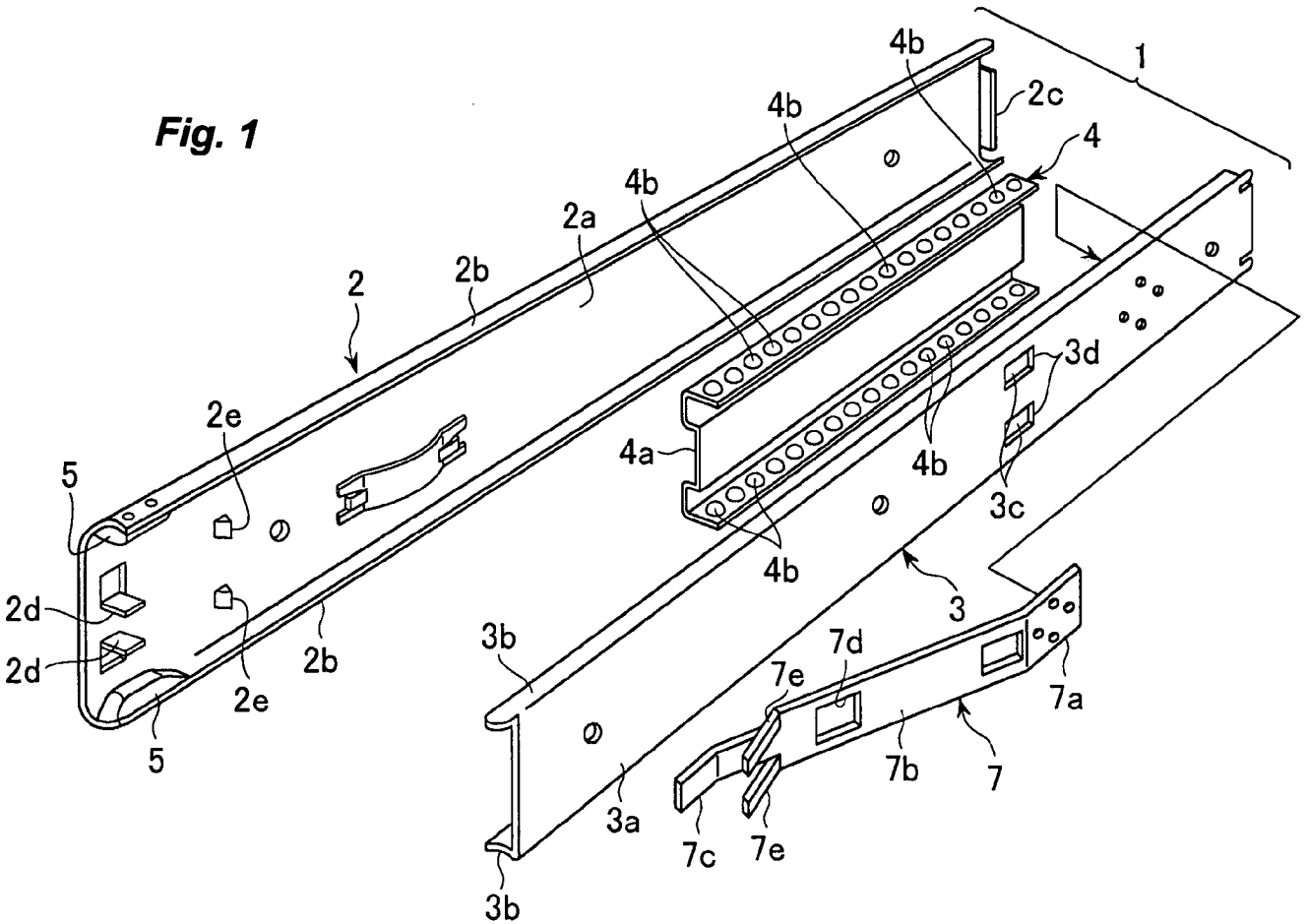
FIG. 1 is an exploded perspective view of a first embodiment of the present invention.
Figure 2:
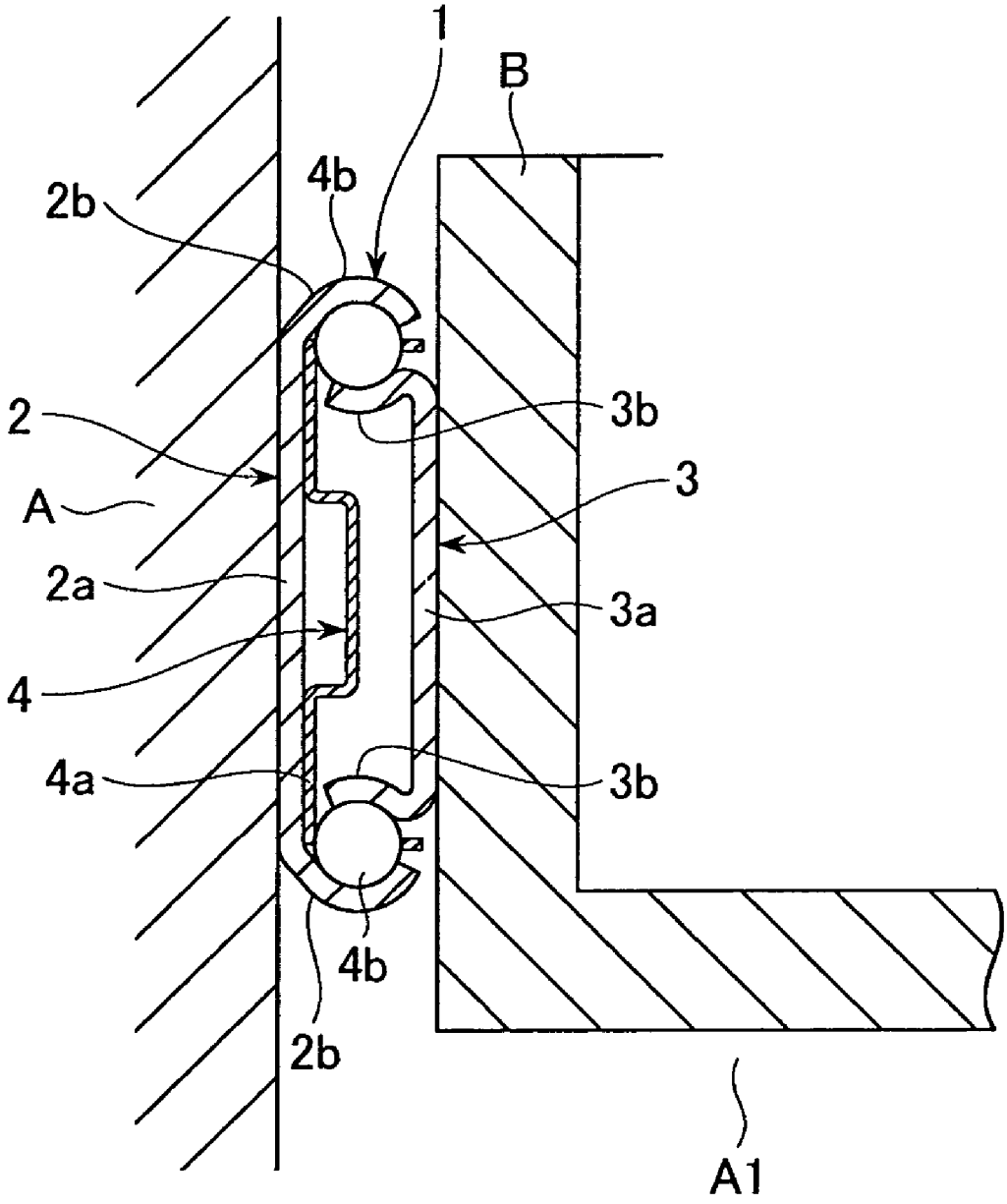
FIG. 2 is a cross sectional view showing how the first embodiment is used.

FIGS. 1 to 6 show a first embodiment of the present invention. First, an explanation will be given of a slide rail 1 on which a stopper apparatus 6 according to the present invention (see FIGS. 3 to 6) is attached. As shown in FIGS. 1 and 2, the slide rail 1 includes a first rail 2, a second rail 3 disposed facing the first rail 2, and a slider 4 which couples the second rail 3 movably to the first rail 2.

The first rail 2, made of a rigid metal plate material, has a flat plate portion 2*a* with an elongated rectangular plate-like shape. The flat plate portion 2*a* is fixed to one of side faces of a housing portion A1 of a body A (see FIG. 2) with a screw (not shown) or the like, such that the longitudinal direction of the flat plate portion 2*a* is in alignment with the back and forth direction. It is needless to say that a flat plate portion 2*a* of a first rail 2 of another slide rail 1 is fixed to the other side face of the housing portion A1. Rail portions 2*b*, 2*b* projecting toward the second rail 3 are formed in both upper and lower side portions of the flat plate portion 2*a* covering the entire length thereof. Each rail portion 2*b* has a generally arc-shaped cross section, and expands in the outward direction (i.e., upward and downward directions in FIG. 2). Guide members 5 are attached to front end portions (i.e., distal end portions) of inner faces of rail portions 2*b*, 2*b* opposing each other, respectively. A stopper plate portion 2*c* is formed in a rear end portion of the flat plate portion 2*a* such that the stopper plate portion 2*c* projects toward the second rail 3. A pair of lock plate portions (lock portions) 2*d*, 2*d* are formed in a front end portion of an inner face of the flat plate portion 2*a*, that faces the second rail 3, by cutting and raising a part of the flat plate portion 2*a*. The lock plate portions 2*d*, 2*d* are separated from each other with a predetermined interval and face each other in the vertical direction.

The second rail 3, made of a rigid metal plate material, has a flat plate portion 3*a* with an elongated rectangular plate-like shape. The flat plate portion 3*a* with the longitudinal direction thereof being in alignment with the back and forth direction, is fixed to one of side faces of a drawer B (see FIG. 2) which is housed so as to be movable in the back and forth direction in the housing portion A1 with a screw (not shown) or the like. It is needless to say that a flat plate portion 3*a* of a second rail 3 of another slide rail 1 is fixed to the other side face of the drawer B. The flat plate portion 3*a* is positioned at the same position as the flat plate portion 1*a* in the vertical direction, such that the flat plate portion 3*a* faces the flat plate portion 2*a* in the right and left direction. The flat plate portion 3*a* has a smaller width in the vertical direction than the flat plate portion 2*a*. Rail portions 3*b*, 3*b* projecting toward the first rail 2 are formed in both upper and lower side portions of the flat plate portion 3*a*. Each rail portion 3*b* has a generally arc-shaped cross section, and expands in the inward direction. The rail portions 3*b*, 3*b* are inserted between the rail portions 2*b*, 2*b* such that an outer face of each rail portion 3*b* faces the inner face of each rail portion 2*b* in the vertical direction. The rail portions 3*b*, 3*b* can be inserted between the rail portions 2*b*, 2*b* of the first rail 2 from the distal end portions of the rail portions 2*b*, 2*b*, such that rear end portions of the rail portions 3*b* serves as a distal end portions. In this case, the rail portions 3*b*, 3*b* can be easily inserted between the rail portions 2*b*, 2*b* by contact of the outer faces of the rail portions 3*b*, 3*b* with the guide members 5, 5, respectively, allowing them to be guided by the guide members 5, 5.

The slider 4 has a ball retention body 4*a* made of a rigid metal plate material. A plurality of balls 4*b* made of a steel ball or the like are disposed at both upper and lower sides of the ball retention body 4*a*, such that the balls 4*b* are aligned in a line in the back and forth direction. Each ball 4*b* is rotatably supported by the ball retention body 4*a*. Further, each ball 4*b* rotatably contacts faces facing each other of the rail portions 2*b*, 3*b*, that is, the inner face of the rail portion 2*b* and the outer face of the rail portion 3*b*. Therefore, the slider 4 is supported by the first rail 2 so as to be movable in the back and forth direction, and the slider 4 supports the second rail 3 such that the second rail 3 is movable in the back and forth direction. Consequently, the second rail 3 is supported by the first rail 2 through the slider 4 so as to be movable in the back and forth direction, whereby the drawer B is supported by the body A by the pair of slide rails 1, 1 so as to be moveable in the back and forth direction.

A moving range in the backward direction of the slider 4 is restricted by contact thereof to a stopper plate portion 2*c*, and a moving range in the forward direction thereof is restricted by contact thereof to a stopper pawl portion 2*e* formed projecting toward the front end of the inner face of the flat plate portion 2*a*. A moving range in the backward direction of the second rail 3 is restricted by contact thereof to the stopper plate portion 2*c*, and a moving range in the forward direction thereof is restricted by the stopper apparatus 6 according to the present invention.

The stopper apparatus 6 is configured by the aforementioned pair of lock plate portions 2*d*, 2*d*, and a stopper member 7 formed in the second rail 3. The stopper member 7, made of an elastic metal plate material, is provided with an attachment plate portion (attachment portion) 7*a* fixed with a screw (not shown) or the like at the rear end portion of the inner face of the flat plate portion 3*a*, that faces the flat plate portion 2*a*, a sloping plate portion (plate portion) 7*b* which is integrally formed so as to be continuous with the front end portion (i.e., distal end portion) of the attachment plate portion 7*a* and which extends in the forward direction, and an operation plate portion 7*c* which is integrally formed so as to be continuous with the front end portion of the sloping plate portion 7*b* and which extends in the forward direction.

Figure 5:
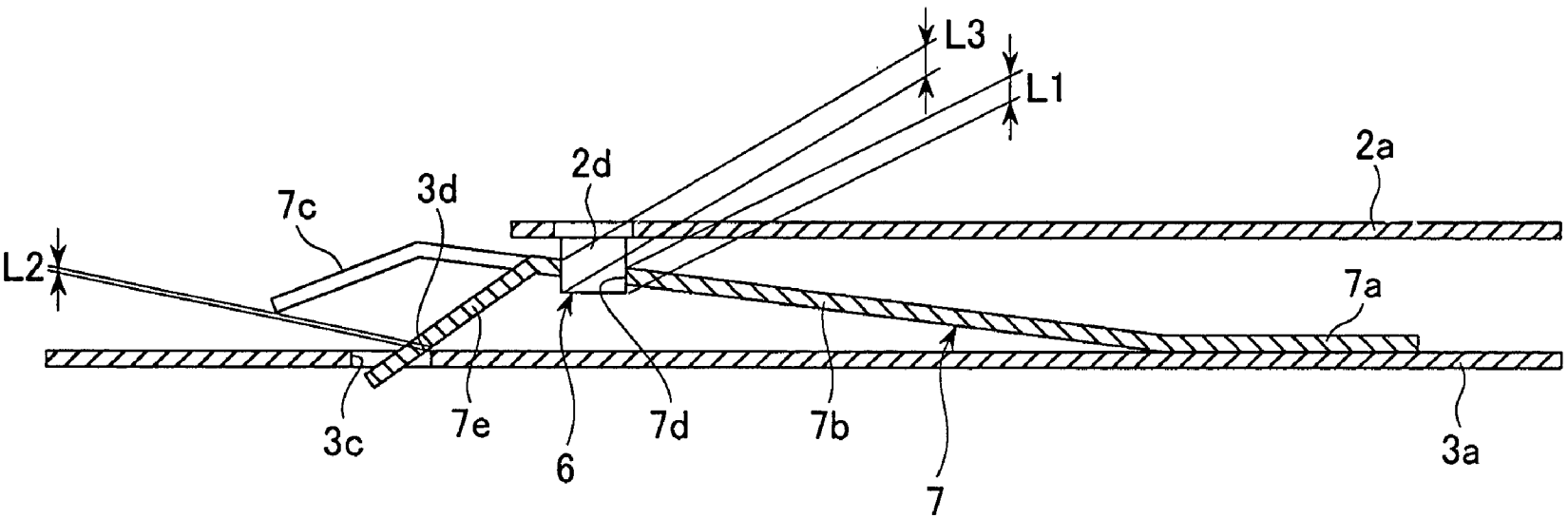
FIG. 5 is a sectional view of the main portion with a state where a lock plate portion is received in a lock hole, which is similar to FIG. 3.

The sloping plate portion 7*b* is formed so as to be continuous with the attachment plate portion 7*a*, being bent with respect to the attachment plate portion 7*a*. The sloping plate portion 7*b* is inclined such that the front end portion of the sloping plate portion 7*b* is closer to the flat plate portion 2*a* of the first rail 2 than the rear portion thereof in a state where the attachment plate portion 7*a* is attached to the inner face of the flat plate portion 3*a*, that faces the flat plate portion 2*a*. A square lock hole (lock recess portion) 7*d* is formed in the front end portion of the sloping plate portion 7*b*. The lock hole 7*d* is disposed such that when the second rail 3 moves in the forward direction to a second position as shown in FIG. 5, the lock hole 7*d* faces the lock plate portion 2*d*. Further, the lock hole 2*d* has a size allowing the two lock plate portions 2*d*, 2*d* to get in and come out of the lock hole 2*d*, simultaneously. Therefore, in a state where the second rail 3 moves to the second position, when the front end portion of the sloping plate portion 7*b* is rotated to the flat plate portion 2*a* side of the first rail 2 around the base end portion of the sloping plate portion 7*b*, the two lock plate portions 2*d*, 2*d* are received in the lock hole 7*d*.

An elastic strip 7*e* is formed at a portion slightly front of the lock hole 7*d* on each of the upper and lower side portions of the sloping plate portion 7*b*. The elastic strip 7*e* is inclined such that the front portion of the elastic stirp 7 is closer to the flat plate portion 3*a* than the rear portion thereof. The elastic stirp 7*e* is formed so as to be elastically deformed such that the front end portion thereof is rotated around the base end portion and displaced in the direction in which the flat plate portion 2*a* of the first rail 2 and the flat plate portion 3*a* of the second rail 3 face each other (in the right and left direction).

Figure 3:
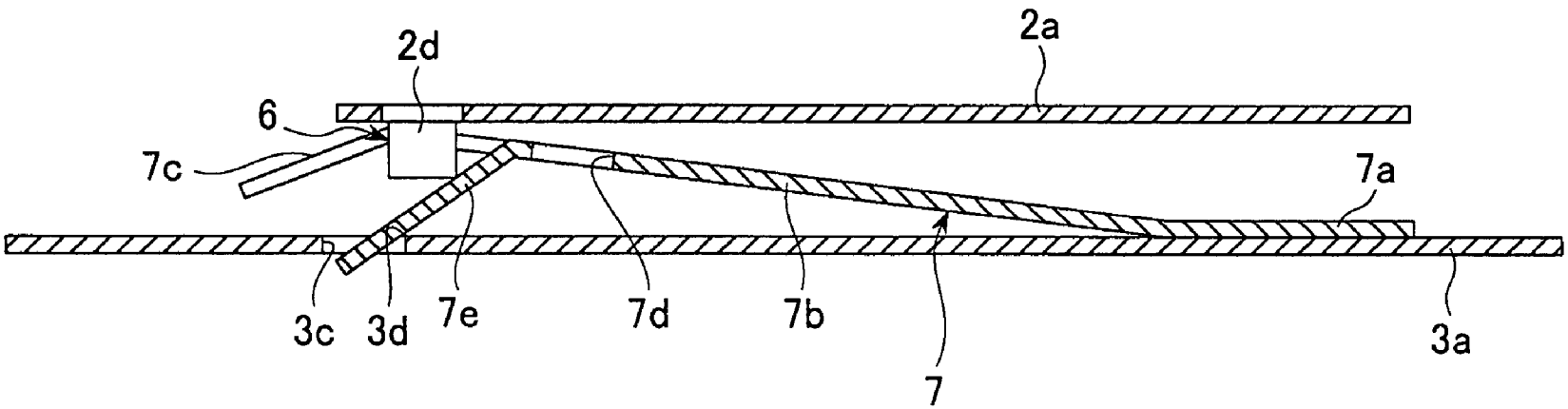
FIG. 3 is a sectional view of a main portion of the first embodiment with a state where a second rail moves to a first position.
Figure 4:
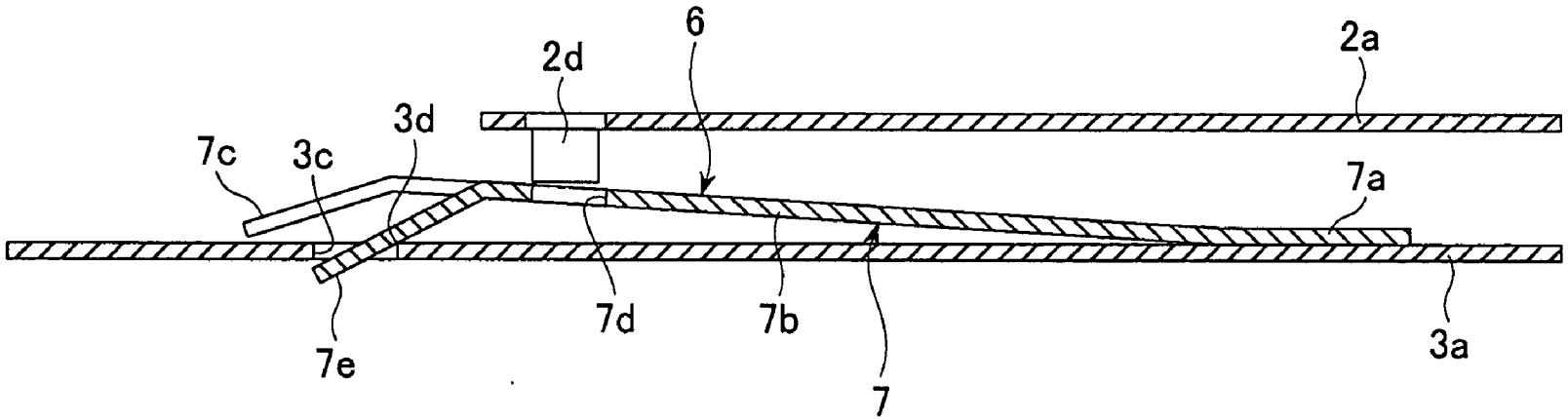
FIG. 4 is a sectional view of the main portion with a state where the second rail moves to a second position, which is similar to FIG. 3.

The elastic strip 7*e* is disposed such that when the second rail 3 moves in the forward direction to the first position as shown in FIG. 3, a face of the elastic strip 7*e*, that faces the flat plate portion 2*a*, contacts the rear end portion of the distal end face (the distal end face in the direction in which the lock plate portion 2*d* rises). Therefore, when the second rail 3 moves forward further than the first position, the elastic strips 7*e*, 7*e* slide on the distal end faces of the lock plate portions 2*d*, 2*d*, respectively. At this time, each elastic strip 7*e* is inclined such that the front portion thereof is closer to the flat plate portion 3*a* than the rear portion thereof. Therefore, when the second rail 3 moves forward further than the first position, the elastic strip 7*e* is pressed to the flat plate portion 3*a* side by the lock plate portion 2*d* in accordance with movement of the second rail 3. By this, the sloping plate portion 7*b* is elastically deformed such that the front end portion of the sloping plate portion 7*b* is rotated around the base end portion and displaced to the flat plate portion 3*a* side. As apparent from this, in the first embodiment, the elastic strip 7*e* also serves as the guide portion. Note that, when the front end portion of the sloping plate portion 7*b* is displaced to the flat plate portion 3*a* side, the elastic strip 7*e* is accordingly displaced to the flat plate portion 3*a* side.

When the second rail 3 further moves in the forward direction, and the lock plate portion 2*d* has relatively climbed over the base end portion of the elastic strip 7*e*, the sloping plate portion 7*b* slides on the rear end portion of the distal end face of the two lock plate portions 2*d*, 2*d*. The sloping plate portion 7*b* is inclined such that the front portion thereof is closer to the flat plate portion 2*a* than the rear portion thereof. Therefore, when the sloping plate portion 7*b* slides on the lock plate portion 2*d*, the sloping plate portion 7*b* is elastically deformed so as to return to the original position such that the front end portion of the sloping plate portion 7*b* approaches the flat plate portion 2*a* in accordance with movement of the second rail 3 in the forward direction. Subsequently, when the second rail 3 moves forward to the second position as shown in FIG. 5, the lock plate portions 2*d*, 2*d* face the lock hole 7*d*. At this time, the sloping plate portion 7*b* maintains a state where the sloping plate portion 7*b* is elastically deformed toward the flat plate portion 3*a*. Therefore, when the lock plate portions 2*d*, 2*d* face the lock hole 7*d*, the front end portion of the sloping plate portion 7*b* is displaced so as to return to the original position such that the front end portion thereof approaches the flat plate portion 2*a* by an amount equivalent to an amount of elastic deformation of the sloping plate portion 7*b*. As a result, the plate portions 2*d*, 2*d* are received in the lock hole 7*d*. In this case, since the sloping plate portion 7*b* is inclined such that the front end portion thereof is closer to the flat plate portion 2*a* than the rear portion thereof, a distance for which the lock plate portion 2*d* is inserted in the lock hole 7*d* (hereinafter referred to as an insertion distance) is the smallest at the rear end portion of the lock plate portion 2*d* and the largest at the front end portion. When the sloping plate portion 7*b* is displaced so as to return to the natural condition where no outer force acts thereon, the rear end portion of the lock plate portion 2*d* is inserted in the lock hole 7*d* for an insertion distance L1 as shown in FIG. 5.

In a state where the lock plate portion 2*d* is inserted in the lock hole 7*d*, when an attempt is made to move the second rail 3 in the forward direction, the rear end face of the lock hole 7*d* contacts the rear end face of the lock plate portion 2*d*. Accordingly, the second rail 3 is inhibited from moving in the forward direction. On the contrary, when an attempt is made to move the second rail 3 in the backward direction, the front end face of the lock hole 7*d* contacts the rear end face of the lock plate portion 2*d*. Accordingly, the second rail 3 is inhibited from moving in the backward direction. Moreover, the lengths of the lock plate portion 2*d* and the lock hole 7*d* in the back and forth direction are set to a substantially similar value. Therefore, in a state where the lock plate portion 2*d* is inserted in the lock recess portion 7*d*, the second rail 3 rarely moves in the back and forth direction.

Front end portions of the elastic strips 7*e*, 7*e* are inserted, with a gap, into through holes 3*c*, 3*c* that are formed in the flat plate portion 3*a* of the second rail 3, respectively, when the stopper member 7 is in the natural condition. Therefore, when the lock plate portion 2*d* is inserted in the lock hole 7*d*, the elastic strip 7*e* is separated from the inner face of the flat plate portion 3*a* and the inner peripheral face of the through hole 3*c*. This is because the stopper member 7 is in the natural condition when the lock plate portion 2*d* is inserted in the lock hole 7*d*. A distance between the elastic strip 7*e* and an intersection portion of the inner face of the flat plate portion 3*a* and the inner peripheral face of the through hole 3*c* in the right and left direction (that is, the direction in which the flat plate portions 2*a*, 3*a* face each other) is the smallest at an intersection portion (abutment portion) 3*d* of the rear end portion of the inner peripheral face of the thorough hole 3*c* and the inner face of the flat plate portion 3*a*. When a separation distance between the elastic strip 7*e* and the intersection portion 3*d* in the right and left direction is assumed to be L2, the insertion distance L1 and the separation distance L2 as described above have a following relation.

L1>L2

Therefore, when the second rail 3 moves from the first position toward the second position and reaches a predetermined intermediate position for a predetermined distance (that is, a distance in the backward direction corresponding to an angle of gradient of the elastic strip 7*e* and the separation distance L2), the elastic strip 7*e* is forced to move toward the flat plate portion 3*a* by the distance L2. Therefore, the front end portion of the face, of the elastic strip 7*e*, which faces the flat plate portion 3*a*, abuts against the intersection portion 3*d*. After this, until the base end portion of the elastic strip 7*e* (that is, the intersection portion of the elastic strip 7*e* and the sloping plate portion 7*b*) slides over the lock plate portion 2*d*, the elastic strip 7*e* is forced to abut against the intersection portion 3*d* more strongly in accordance with movement of the second rail 3 in the forward direction. After the base end portion of the elastic strip 7*e* slided over the lock plate portion 7*d*, the sloping plate portion 7*b* is deformed so as to return to the flat plate portion 2*a* side, and accordingly the elastic strip 7*e* is also deformed so as to return to the flat plate portion 2*a* side. However, the elastic strip 7*e* abuts against the intersection portion 3*d* and remains elastically deformed, even when the second rail 3 reaches the second position. Therefore, when the second rail 3 moves in the forward direction to the second position and the lock plate portion 2*d* faces the lock hole 7*d*, the sloping plate portion 7*b* is deformed so as to return to the flat plate portion 2*a* side not only by elasticity of the sloping plate portion 7*b* itself, but also by elasticity of the elastic strip 7*e*. When the sloping plate portion 7*b* is displaced so as to return toward the original position by a distance (L1–L2), the elastic strip 7*e* separates from the intersection portion 3*d*. Therefore, after this, the sloping plate portion 7*b* is deformed so as to return to the original position only by elasticity of itself.

The operation plate portion 7*c* is formed so as to be continuous with the sloping plate portion 7*b*, being bent with respect to the sloping plate portion 7*b*. The operation plate portion 7*c* is inclined such that the front end portion thereof is closer to the flat plate portion 3*a* than the rear portion thereof. The operation plate portion 7*c* may be formed in parallel with the flat plate portions 2*a*, 3*a*. The width of the operation plate portion 7*c* is slightly smaller than a distance between the pair of lock plate portions 2*d*, 2*d*. The operation plate portion 7*c* is received between the pair of lock plate portions 2*d*, 2*d* so as to be movable in the back and forth direction and the right and left direction, when the second rail 3 is positioned at or in the vicinity of the first position. Moreover, as shown in FIG. 5, when the second rail 3 is positioned at the second position, the operation plate portion 7*c* projects from the flat plate portion 2*a* in the forward direction. Therefore, it is possible to move the operation plate portion 7*c* toward the flat plate portion 3*a* side, for example, by pressing it with a finger. The lock plate portion 2*d* can get out of the lock hole 7*d* by pressing the operation plate portion 7*c* to the flat plate portion 3*a* side so as to elastically displace the sloping plate portion 7*b* to the flat plate portion 3*a* side. The lock plate portion 2*d* can get out of the lock hole 7*d* if the operation plate portion 7*c* is pressed to the flat plate portion 3*a* side, until immediately before the front end portion of the operation plate portion 7*c* contacts the flat plate portion 3*a*. Therefore, the lock plate portion 2*d* can reliably get out of the lock hole 7*d* by pressing the operation plate portion 7*c* to the flat plate portion 3*a* side until the front end portion of the operation plate portion 7*c* contacts the flat plate portion 3*a*.

Assume that, in the slide rail 1 having the stopper apparatus 6 with the aforementioned structure, the second rail 3 is positioned rearward of the first position. When the second rail 3 is moved in the forward direction from the state above to the first position, as shown in FIG. 3, the elastic strip 7*e* contacts the rear end portion of the distal end face of the lock plate portion 2*d*. When the second rail 3 is moved further in the forward direction, the elastic strip 7*e* is pressed to the flat plate portion 3*a* side by the lock plate portion 2*d*. Accordingly, the sloping plate portion 7*b* is elastically deformed such that the front end portion of the sloping plate portion 7*b* approaches the flat plate portion 3*a*. When the sloping plate portion 7*b* is elastically deformed, in accordance with this deformation, the elastic strip 7*e* moves so as to approach the intersection portion 3*d*. Subsequently, when the second rail 3 reaches the intermediate position, the sloping plate portion 7*b* is further elastically deformed to the flat plate portion 3*a* side, and the elastic strip 7*e* abuts against the intersection portion 3*d*. After this, until the elastic strip 7*e* slides over the lock plate portion 2*d*, elastic deformation amounts of the sloping plate portion 7*b* and the elastic strip 7*e* gradually increase in accordance with movement of the second rail 3 in the forward direction. After this, until the second rail 3 reaches the second position, although elastic deformation amounts of the sloping plate portion 7*b* and the elastic strip 7*e* gradually decrease, the sloping plate portion 7*b* and the elastic strip 7*e* remain elastically deformed (see FIG. 4). Moreover, the elastic strip 7*e* contacts the intersection portion 3*d*.

When the second rail 3 reaches the second position and the lock plate portion 2*d* faces the lock hole 7*d*, the sloping plate portion 7*b* is deformed such that the front end portion thereof approaches the flat plate portion 2*a* by elastic force of the sloping plate portion 7*b* and elastic force of the elastic strip 7*e*. Consequently, the lock plate portion 2*d* is relatively inserted in the lock hole 7*d*. As described above, when the second rail 3 moves in the forward direction to the second position, the sloping plate portion 7*b* is moved to the flat plate portion 2*a* side, not only by elastic force of the sloping plate portion 7*b* itself, but also by elastic force of the elastic strip 7*e*. Therefore, the lock plate portion 2*d* can be reliably inserted in the lock hole 7*d*. Note that in the state where the lock plate portion 2*d* is inserted in the lock hole 7*d*, when an attempt is made to move the second rail 3 further in the forward direction, the rear end face of the lock plate portion 2*d* and the rear end face of the lock hole 7*d* contact each other. Therefore, the second rail 3 is inhibited from moving in the forward direction. It is needless to say that movement of the second rail 3 in the backward direction is also inhibited by contact of the front end face of the lock plate portion 2*d* and the front end face of the lock hole 7*d* with each other.

In the case of causing the lock plate portion 2*d* to get out of the lock hole 7*d*, when the sloping plate portion 7*b* is displaced to the flat plate portion 3*a* side by the distance L2, the elastic strip 7*e* abuts against the intersection portion 3*d*. Therefore, when an attempt is made to cause the lock plate portion 2*d* to get out of the lock hole 7*d* by moving the second rail 3 in the forward direction from the second position, the sloping plate portion 7*b* needs to be displaced by the distance (L1–L2) resisting the elastic force of the sloping plate portion 7*b* and the elastic force of the elastic strip 7*e*. Therefore, the state where the lock plate portion 2*d* is inserted in the lock hole 7*d* is reliably maintained. On the other hand, there is a case where an attempt is made to move the second rail 3 in the backward direction from the second position whereby the lock plate portion 2*d* gets out of the lock hole 7*d*. In this case, when an insertion distance of the front end of the lock plate portion 2*d* with respect to the lock hole 7*d* is L3 (see FIG. 5), the sloping plate portion 7*b* needs to be displaced by a distance (L3–L2) resisting the elastic force of the sloping plate portion 7*b* and the elastic force of the elastic strip 7*e*. Here, since the sloping plate portion 7*b* is inclined such that the front end portion thereof is closer to the flat plate portion 2*a* than the rear portion thereof, the following relation is applied.

$$L3>L2$$

Therefore, when moving the second rail 3 in the backward direction from the second position, the state where the lock plate portion 2*d* is inserted in the lock hole 7*d* is more reliably maintained.

Further, the sloping plate portion 7*b* is displaced so as to return to the flat plate portion 2*a* side, not only by the elastic force of the sloping plate portion 7*b* itself, but also by the elastic force of the elastic strip 7*e*. Therefore, it is possible to easily deform the sloping plate portion 7*b* by reducing the modulus of elasticity. Accordingly, it is possible to prevent the sloping plate portion 7*b* from being damaged at the intersection portion of the sloping plate portion 7*b* and the attachment plate portion 7*a* at an early stage.

Figure 6:
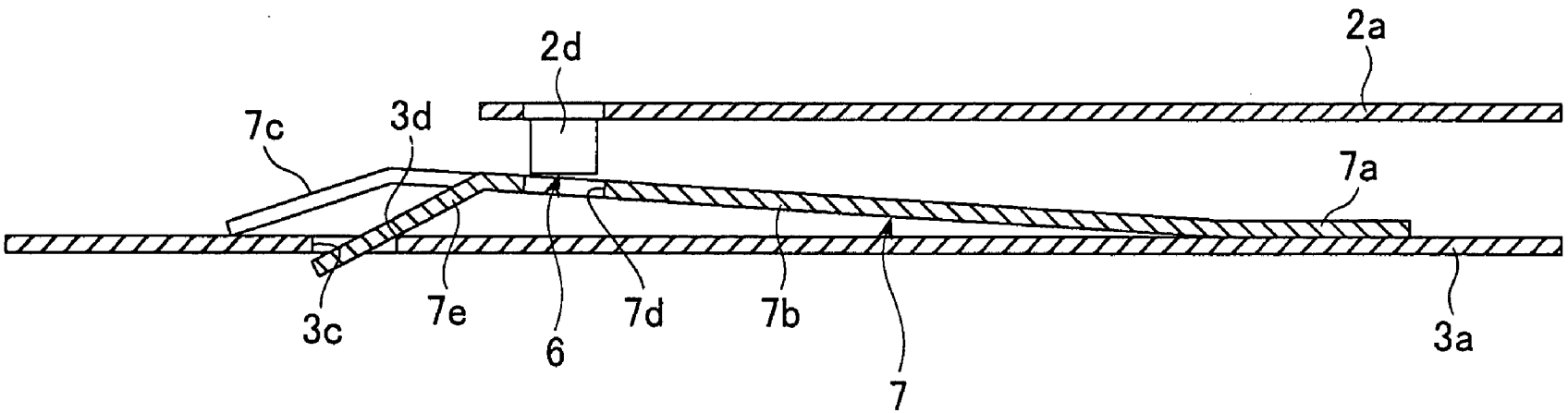
FIG. 6 is a sectional view of the main portion with a state where the lock plate portion gets out of the lock hole, which is similar to FIG. 3.

Note that in the state where the lock plate portion 2*d* is inserted in the lock hole 7*d*, as shown in FIG. 6, the lock plate portion 2*d* can get out of the lock hole 7*d* by pressing the operation plate portion 7*c* to the flat plate portion 3*a* side and moving the front end portion of the sloping plate portion 7*b* resisting the elastic force of the sloping plate portion 7*b* and the elastic force of the elastic strip 7*e*. By causing the lock plate portion 2*d* to get out of the lock hole 7*d*, the second rail 3 is capable of moving in the back and forth direction from the second position.

Next, other embodiments of the present invention will be explained. Note that, for those embodiments, only the structure which is different from that of the first embodiment will be explained hereafter. Similar structural elements will be denoted by the same numerals and the explanation thereof will be omitted.

Figure 7:
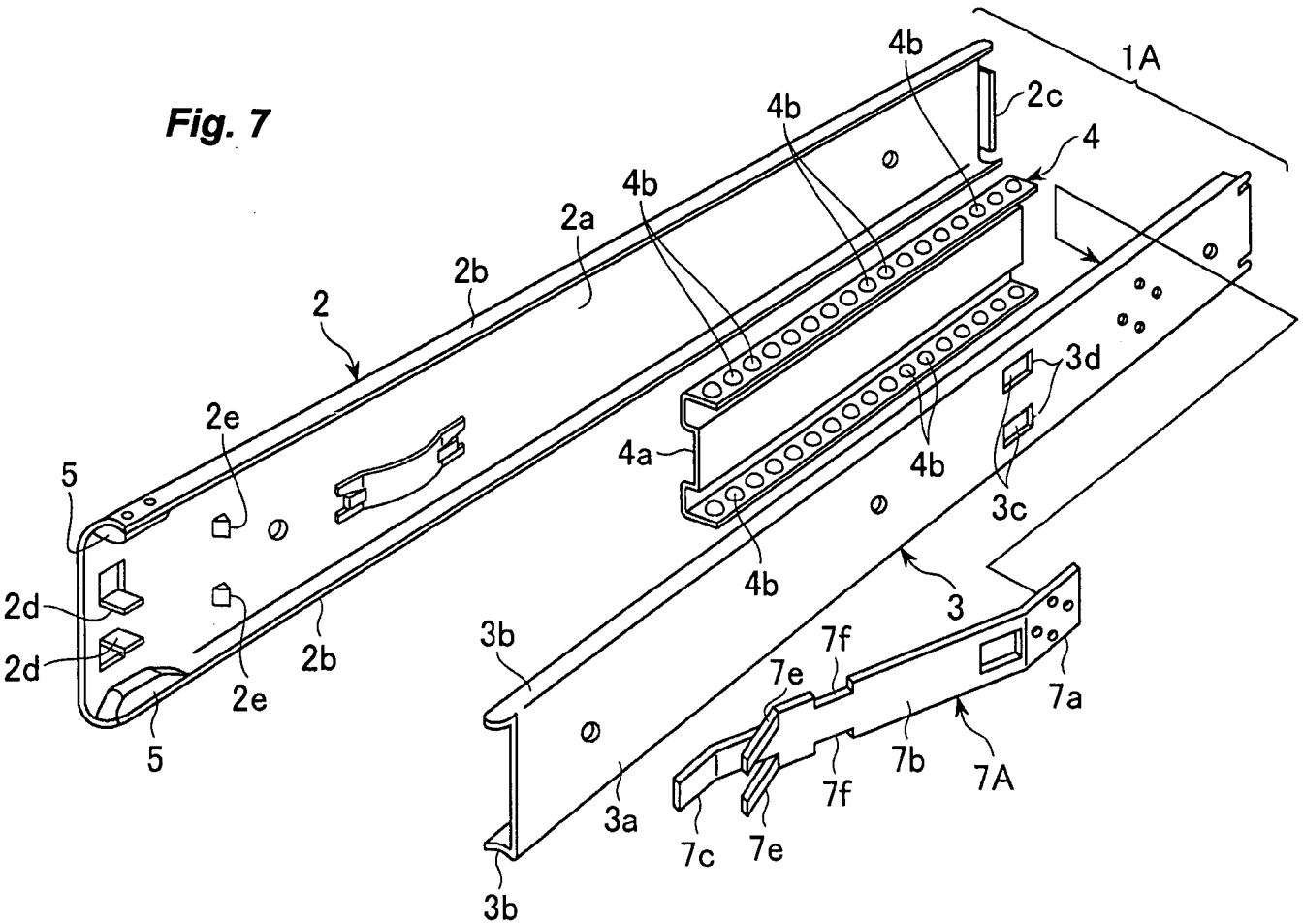
FIG. 7 is an exploded perspective view of a second embodiment of the present invention.

FIG. 7 shows a second embodiment of the present invention. In a slide rail 1A of the present embodiment, a stopper member 7A is used in place of the stopper member 7 which is used in the aforementioned embodiment. In the stopper member 7A, in place of the lock hole 7*d*, a pair of lock recess portions 7*f*, 7*f* are formed in upper and lower side portions of the sloping plate portion 7*b*, respectively. It is needless to say that the lock recess portions 7*f*, 7*f* are disposed such that when the second rail 3 moves in the forward direction to the second position, the lock plate portions 2*d*, 2*d* are received in the lock recess portions 7*f*, 7*f*, respectively.

Figure 8:
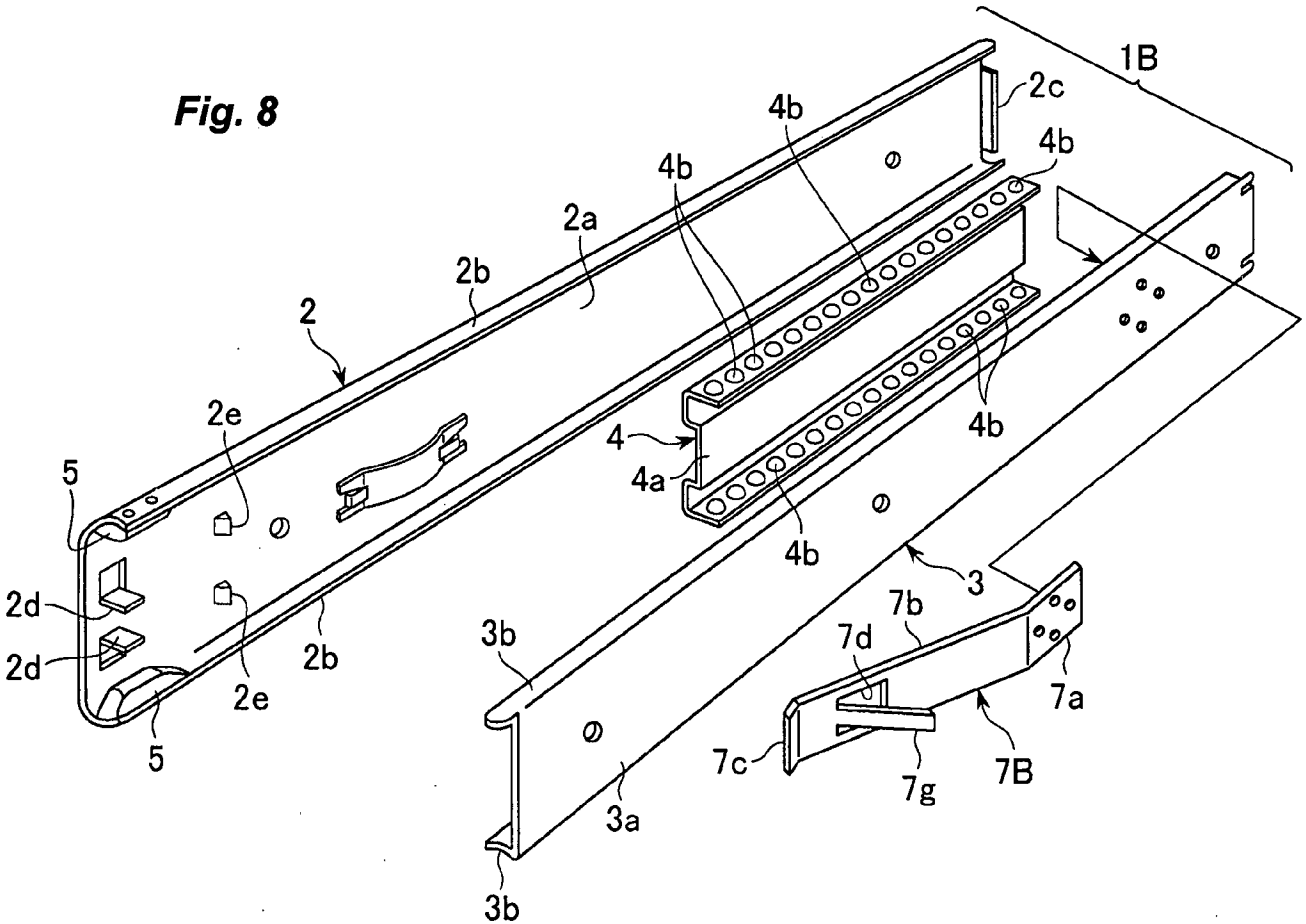
FIG. 8 is an exploded perspective view of a third embodiment of the present invention.

FIG. 8 shows a third embodiment of the present invention. In a slide rail 1B of the present embodiment, a stopper member 7B is used in place of the stopper member 7. In the stopper member 7B, when the second rail 3 moves in the forward direction to the first position, the operation plate portion 7*c* contacts the lock plate portion 2*d*. After this, until the time when the base end portion of the operation plate portion 7*c* slides over the lock plate portion 2*d*, the operation plate portion 7*c* is pressed by the lock plate portion 2*d* to the flat plate portion 3*a* side in accordance with movement of the second rail 3 in the forward direction whereby the sloping plate portion 7*b* is elastically deformed to the flat plate portion 3*a* side. As apparent from this, in the slide rail 1B, the operation plate portion 7*c* also serves as the guide portion. Further, in the slide rail 1B, in place of the two elastic strips 7*e*, 7*e*, a single elastic strip 7*g* is formed in the stopper member 7B. The elastic strip 7*g* is disposed at a central portion in the width direction of the stopper member 7B. The base end portion of the elastic strip 7*g* is integrally formed with the sloping plate portion 7*b* at a portion facing the front end portion of the lock hole 7*d* of the sloping plate portion 7*b*, and the front end portion of the elastic strip 7*g* extends toward the rear of the slide rail 1B. Moreover, the elastic strip 7*g* is inclined such that the rear portion thereof is closer to the flat plate portion 3*a* than the front portion thereof. The distal end portion of the elastic strip 7*g* is press-contacted with the inner face of the flat plate portion 3*a*, by elastic force of the elastic strip 7*g* itself. Therefore, a portion, which is press-contacted by the elastic strip 7*g* of the inner face of the flat plate portion 3*a* constitutes an abutment portion. In this case, the elastic strip 7*g* is always press-contacted with the flat plate portion 3*a*, however, it does not need to be always press-contacted with the flat plate portion 3*a*. It is sufficient if the elastic strip 7*g* is press-contacted with the flat plate portion 3*a* when the second rail 3 is positioned between the intermediate position and the second position. Note that the elastic strip 7*g* is inserted between the lock plate portions 2*d*, 2*d* so as to be movable in the back and forth direction and the right and left direction when the second rail 3 is positioned at or in the vicinity of the second position.

Figure 9:
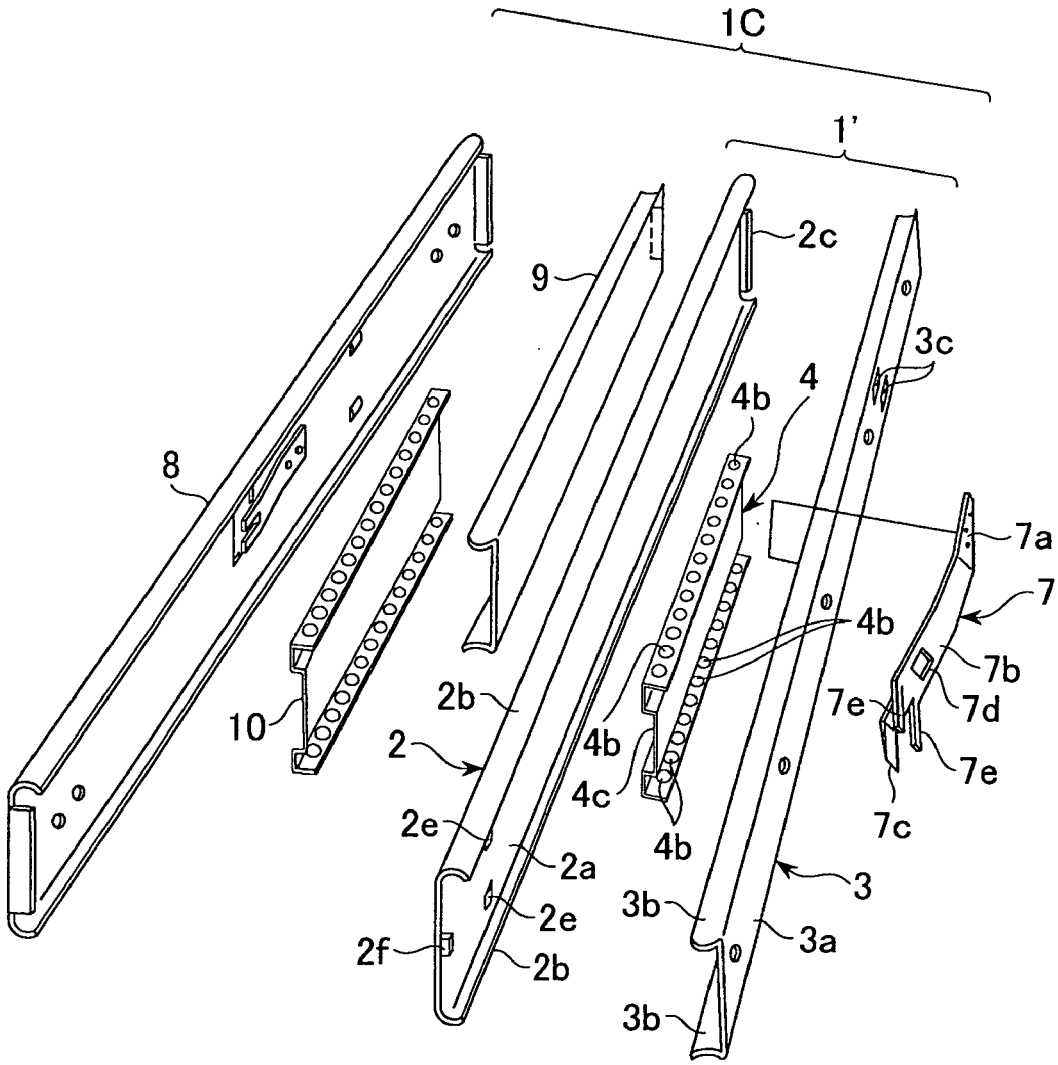
FIG. 9 is an exploded perspective view of a fourth embodiment of the present invention.

FIG. 9 shows a fourth embodiment of the present invention. A slide apparatus 1C according to the fourth embodiment is a modified version of a slide 1' such that the whole slide apparatus 1' is movable in the back and forth direction. The slide apparatus 1' is slightly modified from the slide apparatus 1 according to the first embodiment. That is, in the slide apparatus 1C, a fixed rail 8, a movable rail 9 and a slider 10 are added to the slide apparatus 1'. The fixed rail 8 is fixed to a side face of the housing portion A1 (see FIG. 2) such that the longitudinal direction thereof is in alignment with the back and forth direction. The movable rail 9 is disposed such that the longitudinal direction thereof is in alignment with the back and forth direction, it faces the fixed rail 8. The movable rail 9 is supported by the fixed rail 8 through the slider 10 so as to be movable in the back and forth direction. The first rail 2 is fixed to the movable rail 9 such that the longitudinal direction of the first rail 2 is in alignment with the back and forth direction whereby the first rail 2 is movable in the back and forth direction and the whole slide apparatus 1' is also movable in the back and forth direction. Moreover, in place of the lock plate portion 2*d*, a lock protruding portion (lock portion) 2*f* is formed in the first rail 2 of the slide apparatus 1'. The lock protruding portion 2*f*, formed in a rectangular parallelepiped, has the same shape and dimension as a member which is formed by filling a gap between the two lock plate portions 2*d*, 2*d*. Therefore, the lock protruding portion 2*f* is capable of getting in and coming out of the lock hole 7*f*. The other structure of the slide apparatus 1' is the same as the slide apparatus 1.

Note that the present invention is not limited to the aforementioned embodiments, and modification of the embodiments is possible as necessary, as long as it does not deviate from the gist of the embodiment.

For example, in the aforementioned embodiments, the sloping plate portion 7*b*, which is inclined such that the front portion thereof is closer to the flat plate portion 2*a* than the rear portion thereof, is employed as a plate portion. However, in place of the sloping plate portion 7*b* like this, a plate portion with a step-like bent shape may be employed. The plate portion may be structured such that it is bent at a substantially right angle at the front end portion of the attachment portion 7*a* so as to approach the flat plate portion 2*a* side, and subsequently it is bent at a substantially right angle so as to extend in the forward direction along the flat plate portion 2*a*.

Further, according to the first and second embodiments, the front end portion of the elastic strip 7*e* is separated from the intersection portion 3*d* when the sloping plate portion 7*b* is in the natural condition. The front end portion of the elastic strip 7*e* may contact the intersection portion 3*d* even when the sloping plate portion 7*b* is in the natural condition.

Moreover, in the aforementioned embodiments, the elastic strip 7*e* or the operation plate portion 7*c* serves also as the guide portion. Instead, a guide portion which is independent of the elastic strip 7*e* and the operation plate portion 7*c* may be formed in the stopper member 7.

What is claimed is:

1. A stopper apparatus for a slide rail having a first rail and a second rail which are coupled so as to be capable of mutual relative movement in a longitudinal direction, the stopper apparatus comprising:

a lock portion which projects toward the second rail and which is formed in a distal end portion of an inner face of the first rail, this inner face facing the second rail;

a stopper member made of an elastic plate material formed in a rear end portion of the inner face of the second rail, facing the first rail; the stopper member comprising:

an attachment portion which is formed in a base end portion of the stopper member, and which is fixed to the inner face of the second rail;

a plate portion which is formed so as to be continuous with a distal end portion of the attachment portion, and which extends toward the distal end portion of the second rail such that the plate portion is separated from the inner face of the second rail; and a guide portion which is formed so as to be continuous with the distal end portion of the plate portion, such that, when the second rail moves toward a distal end side and reaches a predetermined first position, the guide portion contacts the lock portion, and slides on the lock portion in accordance with movement of the second rail from the first position to the distal end side, thereby elastically displacing the plate portion around the base end portion to the second rail side, the plate portion further comprising:

a lock recess portion formed in the distal end portion such that, when the second rail moves further from the first position toward the distal end side and reaches a predetermined second position, the lock recess portion faces the lock portion, and receives the lock portion due to the plate portion being elastically deformed to return to the second rail side, and thereby inhibiting the second rail from moving in the longitudinal direction by engagement of the lock portion with the lock recess portion; and an elastic strip which projects toward the second rail and which elastically urges the plate portion to the inner face side of the first rail by contacting an abutment portion formed in the second rail; wherein when the lock portion is received in the lock recess portion, a distance between the elastic strip and the abutment portion in a direction in which the inner face of the first engagement portion and the inner face of the second engagement portion face each other is set smaller than an insertion distance of the lock portion into the lock recess portion.

2. The stopper apparatus for a slide rail according to claim 1, wherein the second rail is inhibited from moving toward the distal end side by contact of the lock portion with a rear end face of the lock recess portion.

3. The stopper apparatus for a slide rail according to claim 1, wherein the second rail is inhibited from moving toward a rear end side by contact of the lock portion with a distal end face of the lock recess portion.

4. The stopper apparatus for a slide rail according to claim 1, wherein the elastic strip is inclined such that a front portion of the elastic strip is closer to the second rail than the distal end portion thereof so as to also serve as the guide portion, and, when the second rail moves toward the distal end side and reaches the first position, a face of the elastic strip facing the first rail contacts the lock portion.

5. The stopper apparatus for a slide rail according to claim 1, wherein a thorough hole which receives the distal end portion is further formed in the second rail, and the abutment portion is formed at an intersection portion of the inner peripheral face of the through hole and the inner face of the second rail.

6. The stopper apparatus for a slide rail according to claim 1, further comprising a fixed rail and a movable rail such that longitudinal directions of the fixed rail and the movable rail are in alignment with longitudinal directions of the first rail and the second rail, wherein the movable rail is coupled to the fixed rail so as to be movable in the longitudinal direction of the fixed rail and the first rail is fixed to the movable rail.

* * * * *